US009173022B2

(12) United States Patent
Vernon et al.

(10) Patent No.: US 9,173,022 B2
(45) Date of Patent: Oct. 27, 2015

(54) ACOUSTIC TRANSDUCER

(71) Applicant: Sontia Logic Limited, Dronfield (GB)

(72) Inventors: Christopher David Vernon, Dronfield (GB); Weiming Li, Sheffield (GB)

(73) Assignee: Sontia Logic Limited, Dronfield (GB)

( * ) Notice: Subject to any disclaimer, the term of this patent is extended or adjusted under 35 U.S.C. 154(b) by 0 days.

(21) Appl. No.: 14/315,769

(22) Filed: Jun. 26, 2014

(65) Prior Publication Data

US 2015/0003662 A1 Jan. 1, 2015

(30) Foreign Application Priority Data

Jun. 26, 2013 (GB) ..... 1311326.1

(51) Int. Cl.
*H04R 3/00* (2006.01)

(52) U.S. Cl.
CPC ..... *H04R 3/00* (2013.01)

(58) Field of Classification Search
CPC ..... H04R 1/08; H04R 9/08; H04R 11/04; H04R 19/00; H04R 19/01; H04R 19/013; H04R 19/016; H04R 9/048; H04R 9/025; H04R 7/04; H04R 9/027
USPC ..... 381/176, 191, 399, 421, 431
See application file for complete search history.

(56) References Cited

U.S. PATENT DOCUMENTS 4,536,623 A * 8/1985 Larson ..... 381/399
5,953,438 A * 9/1999 Stevenson et al. ..... 381/431
6,480,614 B1 * 11/2002 Denda et al. ..... 381/191

FOREIGN PATENT DOCUMENTS

WO 2006/091747 A2 8/2006

* cited by examiner

*Primary Examiner* — Suhan Ni
(74) *Attorney, Agent, or Firm* — Harness, Dickey & Pierce, P.L.C.

(57) ABSTRACT

An acoustic transducer (104) is shown, which may be configured as either a loudspeaker or a microphone. The acoustic transducer includes a magnet system (401), and a diaphragm (303) having a conductive element (402) disposed on it. The conductive element has a first outer conductive portion (405) and a second outer conductive portion (407) for generating force parallel to the magnet system. It also has a central conductive portion (406) for generating force normal to the magnet system. In this way, application of an audio frequency signal to the conductive element, possibly via positive and negative input terminals (202, 203), causes oscillation of the diaphragm.

19 Claims, 14 Drawing Sheets

ACOUSTIC TRANSDUCER

CROSS REFERENCE TO RELATED APPLICATIONS

This application claims priority from United Kingdom patent application number 13 11 326.1, filed Jun. 26, 2013, the entire disclosure of which is incorporated herein by reference in its entirety.

BACKGROUND OF THE INVENTION

1. Field of the Invention

The present invention relates to acoustic transducers, and particularly, but not exclusively, to loudspeakers.

2. Description of the Related Art

Both loudspeakers and microphones may be characterised as acoustic transducers, by respectively converting electrical energy into some form of mechanical vibration, or vice versa.

Loudspeaker designs may typically be split into two categories: designs such as dynamic loudspeakers, which use a cone supporting a voice coil which acts on a permanent magnet; and designs such as electrostatic and planar-magnetic speakers, which pass an electrical signal through a thin film, which in turn acts on super high tension stators or magnets to generate vibration.

Similar microphone designs exist, as they are the functional opposite of loudspeakers.

A problem with dynamic loudspeaker designs is that, due to the magnetic field created by the voice coil due to current flowing through it, a back-EMF (electromotive force) is created due to interaction with the permanent magnet's fixed field. This moves the loudspeaker away from being purely resistive in its electrical operation, contributing to non-linearities and distortion of the audio being reproduced.

A problem with thin film-type loudspeakers is that they oscillate in a planar fashion, and so the radiation pattern they exhibit is highly directional, especially at higher frequencies. In addition, they require components for generating a magnetic field to be placed on both sides of the thin film so as to generate a uniform magnetic field. This adds to cost and complexity.

BRIEF SUMMARY OF THE INVENTION

According to an aspect of the present invention, there is provided an acoustic transducer comprising a magnet system and a diaphragm having a conductive element disposed thereon which is embraced by the magnetic field of the magnet system, and wherein the conductive element comprises: a first outer conductive portion and a second outer conductive portion for generating force parallel to the magnet system, and a central conductive portion for generating force normal to the magnet system; wherein application of an audio frequency signal to the conductive element causes oscillation of the diaphragm.

According to another aspect of the present invention, there is provided a method of generating sound in which a diaphragm is excited so as to cause compression and rarefaction of air, the method comprising: generating a magnetic field that embraces the diaphragm; and applying an audio signal through a conductive element disposed on the diaphragm to create Lorentz forces that act upon the conductive element, which: cause the diaphragm to deform towards a generally arcuate condition during half-cycles of the audio signal having a first polarity, and cause the diaphragm to deform towards a generally planar condition during half-cycles of the audio signal having a second polarity.

DETAILED DESCRIPTION OF EXAMPLE EMBODIMENTS

FIG. 1

Figure 1:
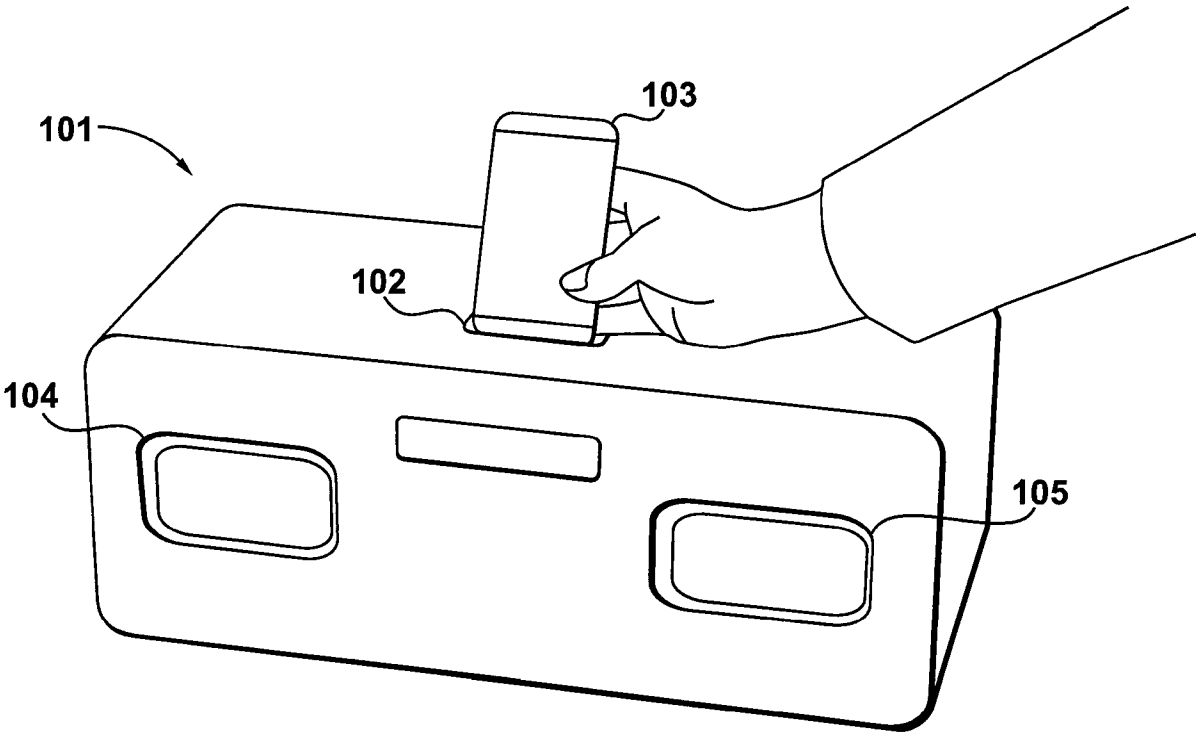
FIG. 1 shows an audio reproduction device, including two loudspeakers.

An audio reproduction device 101 is shown in FIG. 1. The reproduction device includes a digital audio input socket 102 configured to receive a digital audio input signal from a portable device 103, in a configuration often referred to as a dock.

Internally, audio reproduction device 101 includes a digital signal processing system, an amplifier and one or more acoustic transducers. The acoustic transducers included in audio reproduction device 101 have been constructed in accordance with the principles of the present invention, and in this example are configured as a stereo pair of loudspeakers, shown in the Figure as (left) loudspeaker 104 and (right) loudspeaker 105.

It will be appreciated that acoustic transducers constructed in accordance with the principles of the present invention, such as loudspeaker drivers, may be used in a wide range of devices, such as a pair of stereo headphones, sound bars, televisions, notebook computers and tablet computers.

FIG. 2

Figure 2:
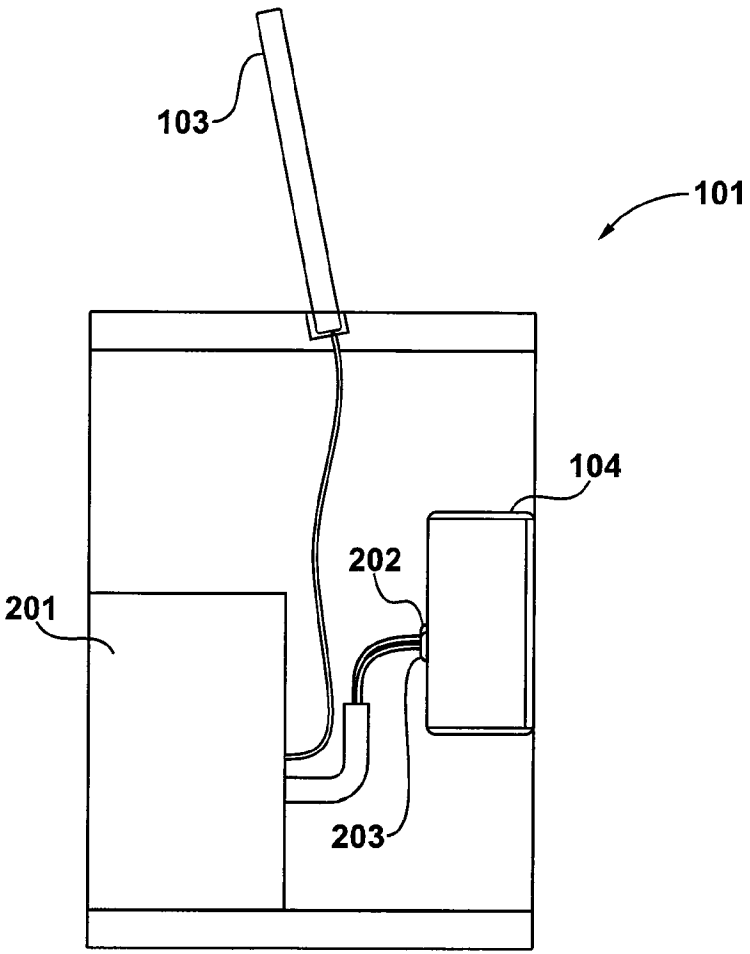
FIG. 2 is a cross-sectional representation of the audio reproduction device, showing the components within it.

A cross-sectional representation of the audio reproduction device 101 is shown in FIG. 2, in which loudspeaker 104 is visible.

Loudspeaker 104 is shown, and is connected to a combined digital signal processing system and amplifier 201, which receives, processes and amplifies digital audio from portable device 103. In this example, loudspeaker 104 converts electrical energy—conveyed from combined digital signal processing system and amplifier 201 via a positive terminal 202 and a negative terminal 203—into mechanical vibration so as to produce audible sound.

FIG. 3

Figure 3:
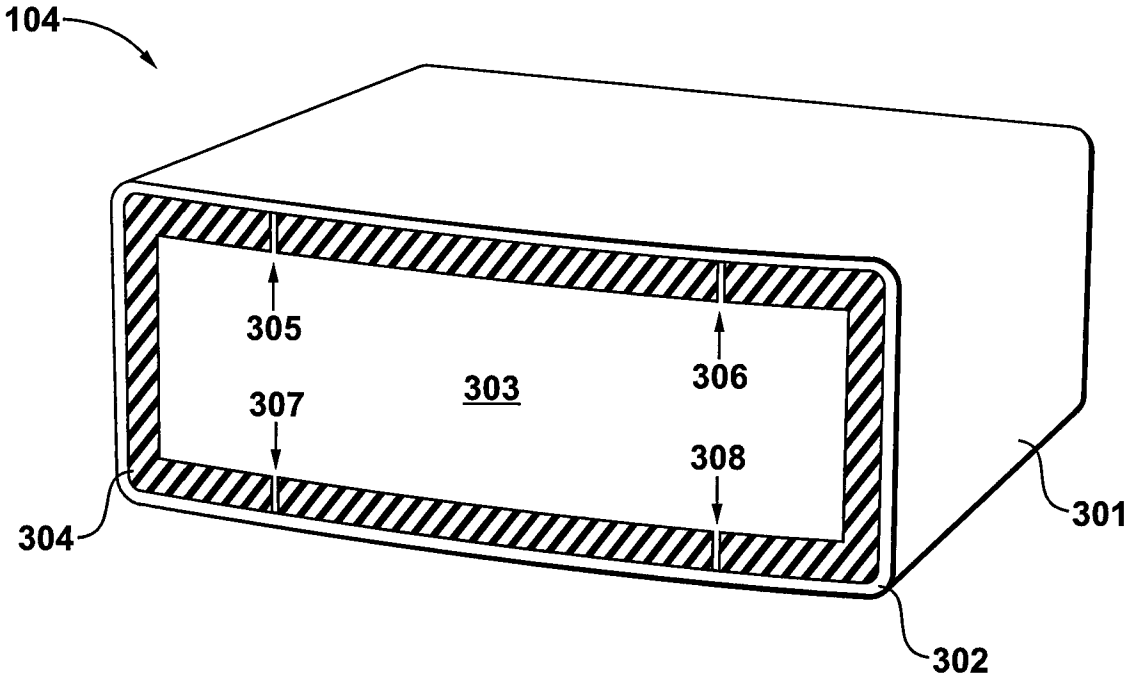
FIG. 3 shows one of the loudspeakers, which embodies the present invention.

A perspective view of loudspeaker 104 is shown in FIG. 3.

Loudspeaker 104 has an enclosure 301, a front face of which is defined as a baffle 302. A diaphragm 303 is mounted within baffle 302, and, as can be seen in the Figure, is elongate in dimension, forming in this embodiment a rectangular surface, although other shapes could be used depending upon the implementation. The periphery of the diaphragm is mounted in the baffle 302 by way of a deformable surround 304.

Deformable surround 304 is, in this embodiment, substantially similar in construction to cone surrounds employed in dynamic loudspeakers, and so allows diaphragm 303 to move relative to baffle 302. In the present embodiment, the deformable surround is formed from rubber (illustrated in the Figure by the hatched lines). In alternative embodiments, deformable surround can be formed from polyester foam, or it can be constructed from a resin coated fabric or any other suitable deformable material in dependence upon the size of loudspeaker 104.

As can be seen in the embodiment illustrated in FIG. 3, diaphragm 303 includes four tabs 305, 306, 307 and 308, which are attached, possibly by glue or other adhesive for example, directly to the baffle 302. Tabs 305 and 306 are positioned on an upper, longer edge of the diaphragm, whilst tabs 307 and 308 are located on a lower, longer edge of the diaphragm. The four tabs firstly serve the purpose of locating diaphragm 303 to the baffle more securely than would be achieved only by way of deformable surround 304, thereby keeping it located substantially centrally relative to the baffle. Further, they also serve the purpose of allowing diaphragm 303 to pivot around substantially fixed points. This feature will be described further with reference to FIG. 14.

FIG. 4

Figure 4:
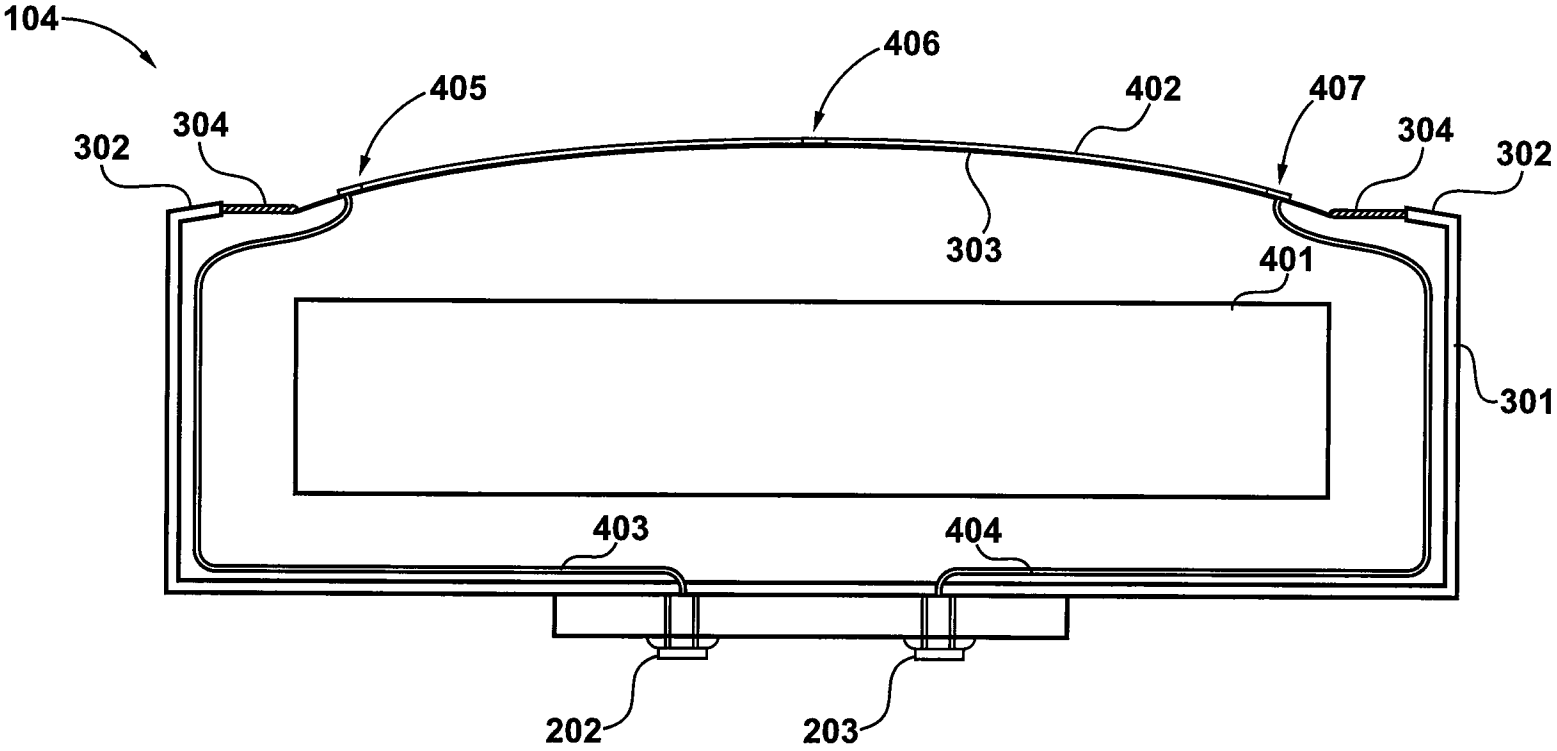
FIG. 4 is a cross-sectional representation of the loudspeaker of FIG. 3, showing the components within it, including a magnet system and a diaphragm having a conductive element disposed upon it.

A top-down, cross-sectional view of loudspeaker 104 is shown in FIG. 4, illustrating schematically its internal components.

Within enclosure 301 is located a magnet system 401. The configuration of magnet system 401 will be described with reference to FIGS. 5A and 5B, which show its magnetic field, and FIGS. 6 and 7, which show the component parts of magnet system 401.

Diaphragm 303, being mounted within baffle 302 by means of deformable surround 304, has a conductive element 402 disposed thereon. Conductive element 402 is connected to positive terminal 202 and negative terminal 203 by way of positive cable 403 and negative cable 404 respectively, so as to allow application of an audio frequency electrical signal.

Conductive element 402 includes two outer conductive portions—first portion 405 and third portion 407—and a central conductive portion—second conductive portion 406. The exact configuration of conductive element 402 will be described further with reference to FIGS. 8A and 8B.

When an audio frequency electrical signal is applied to conductive element 402, current is carried through the three portions 405 to 407. In this way, electromagnetic interactions occur between said portions and the magnetic field of magnet system 401. This causes Lorentz forces to be exerted upon the conductive element 402. In the present embodiment the Lorentz forces act upon first portion 405 and third portion 407 in a direction parallel to the magnet system, and upon second portion 406 in a direction normal the magnet system. This results in oscillation of the diaphragm so as to cause compression and rarefaction of air and thus the generation of sound. This process will be described further with reference to FIGS. 9A through 10B.

FIGS. 5A & 5B

Figure 5B:
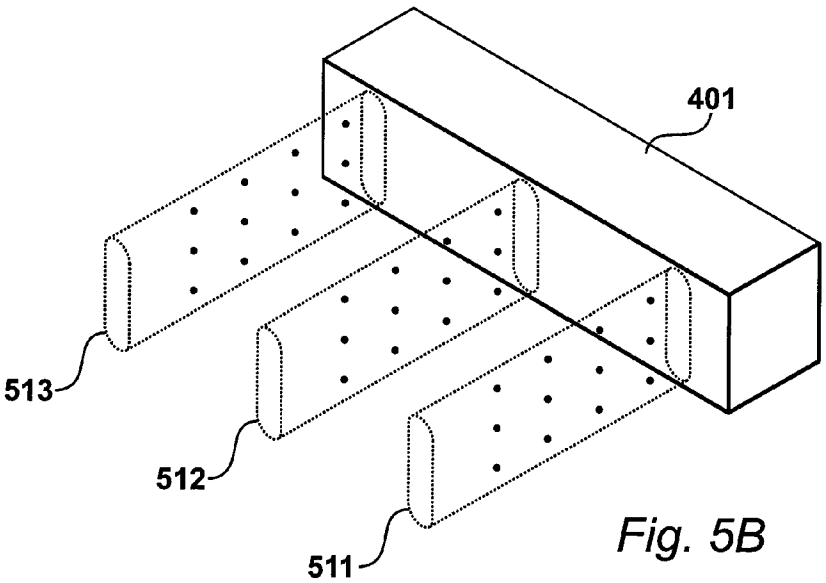
FIGS. 5A and 5B show some properties the magnetic field of the magnet system located within the loudspeaker.
Figure 5A:
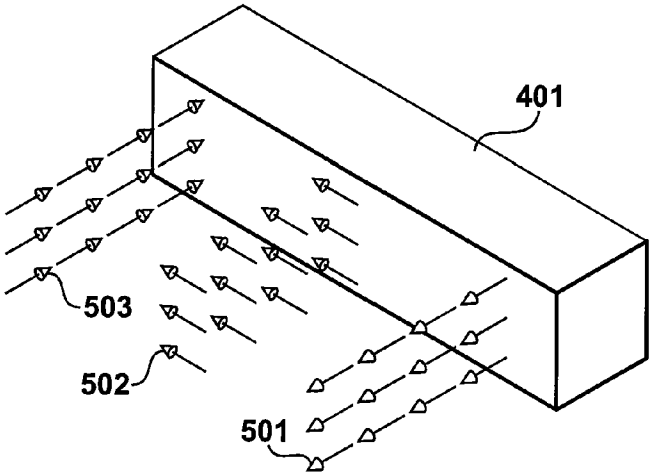

The features of the magnetic field of a specific embodiment of magnet system 401 are shown in an isometric view in FIGS. 5A and 5B.

Field vectors of three portions of the magnetic field of magnet system 401 are shown in FIG. 5A. Field vector 501 is normal to and directed away from the front face of magnet system 401, field vector 502 is parallel to the front face of magnet system 401 whilst being directed away from field vector 501, and field vector 503 is normal to and directed towards the front face of magnet system 401.

FIG. 5B shows the points in space having the field vectors shown in FIG. 5A. The region of space having magnetic field vectors directed in the direction as field vector 501 is defined as a first locus 511. A second locus 512 has field vectors directed in the same direction as field vector 502, and a third locus 513 has field vectors directed in the same direction as field vector 503.

Thus, we may say that the magnetic field associated with the magnet system 401 comprises first locus 511 with field vectors normal to and directed away from the magnet system, second locus 512 with field directed parallel to the magnet system, and third locus 513 with field vectors directed normal to and toward to the magnet system.

In the present embodiment magnet system 401 is constructed from a plurality of permanent magnets, the configuration of which will be described further with reference to FIGS. 6 and 7. Alternatively, one or more electromagnets could be employed depending upon the application.

FIG. 6

Figure 6:
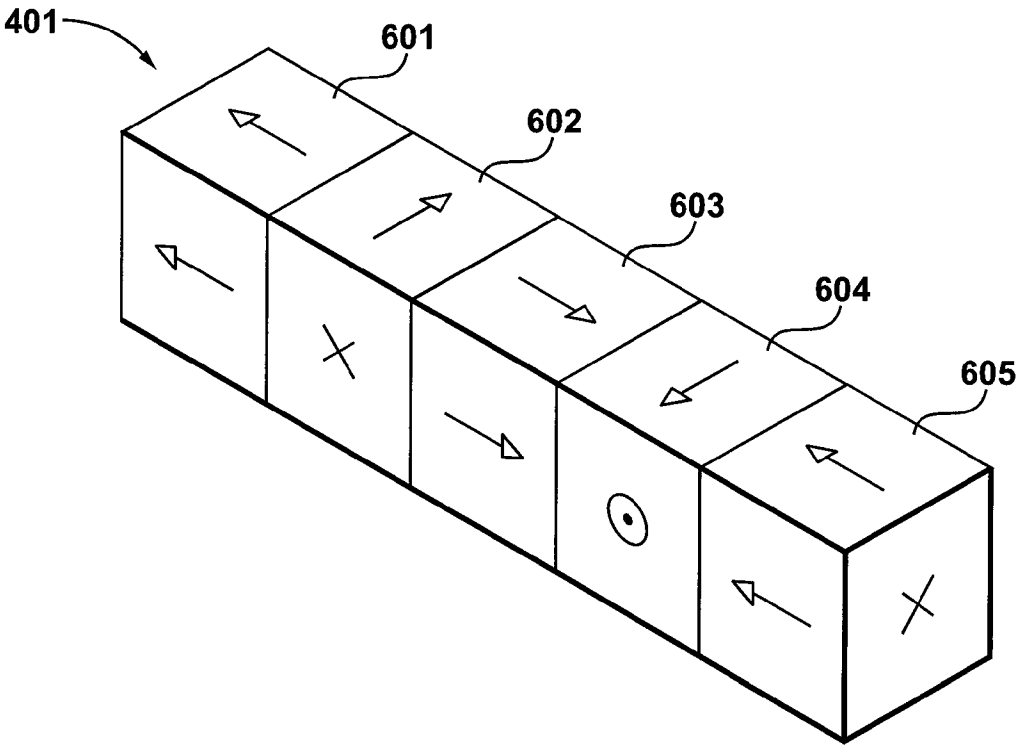
FIG. 6 shows the configuration of permanent magnets that form the magnet system illustrated in FIGS. 5A and 5B.
Figure 7:
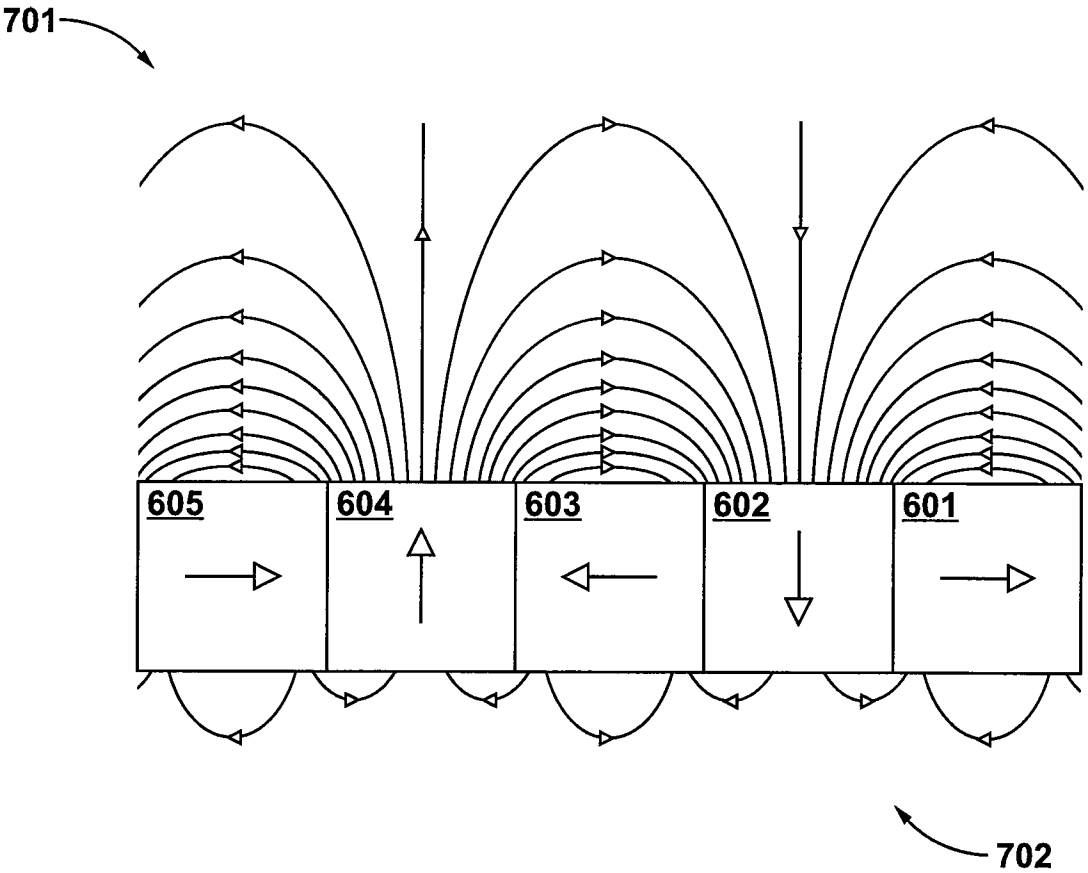
FIG. 7 shows the field lines of the magnetic field of the magnet system illustrated in FIG. 6.

The configuration of magnet system 401 that generates the magnetic field having the three loci illustrated in FIG. 5B, is shown in FIG. 6.

Magnet system 401 is shown generally, and comprises five permanent magnets 601, 602, 603, 604 and 605. The direction of magnetisation of the permanent magnets is denoted by the arrows shown respectively thereon. Thus, it can be seen that in this specific example, magnet system 401 has a spatially rotating pattern of magnetisation. More specifically, the configuration of magnets used in magnet system 401 can be a Halbach array. FIG. 7 illustrates the net magnetic field of the Halbach array.

FIG. 7

Due to the rotating pattern of magnetisation in the magnet system 401, the magnetic flux of each one of permanent magnets 601 to 605 reinforces in the region 701 above the array, and substantially cancels in the region 702 below the array. The field in the region 701 is twice as strong as the strength of the field that the individual permanent magnets exhibit in isolation, whilst little stray field remains in the region 702.

In this embodiment, all of the permanent magnets are of the same size, so as to achieve as uniform a magnetic field as possible. In an alternative embodiment, permanent magnets 602 and 604 are made wider than permanent magnets 601, 603 and 605 so as to widen the first locus 511 and third locus 513 of the magnetic field.

It should be noted that the rotating pattern of magnetisation of the permanent magnets can be continued indefinitely. Indeed, the more permanent magnets that are provided, the more uniform the net magnetic field is. However, it should be noted that the use of a Halbach array is only in one specific embodiment of the present invention. Any configuration of magnet system that provides the three loci described previously with reference to FIGS. 5A and 5B may be used.

FIGS. 8A & 8B

Figure 8A:
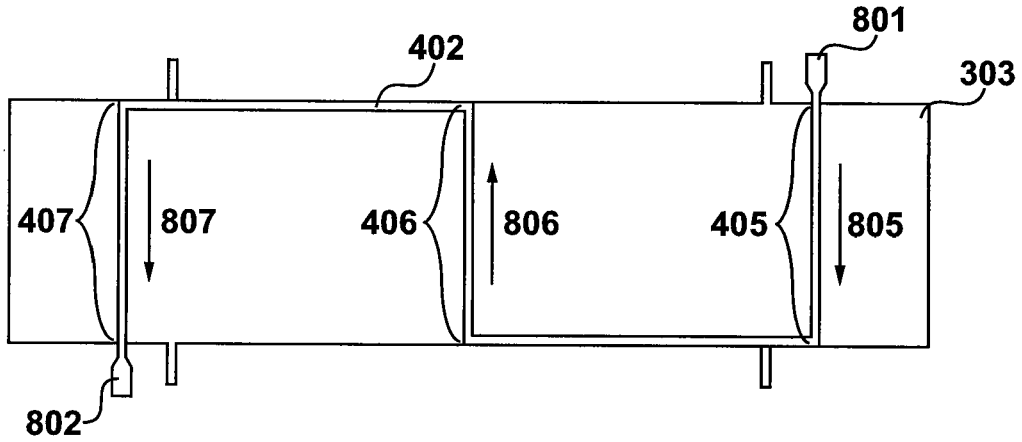
FIGS. 8A and 8B show the diaphragm and conductive element of the loudspeaker.
Figure 8B:
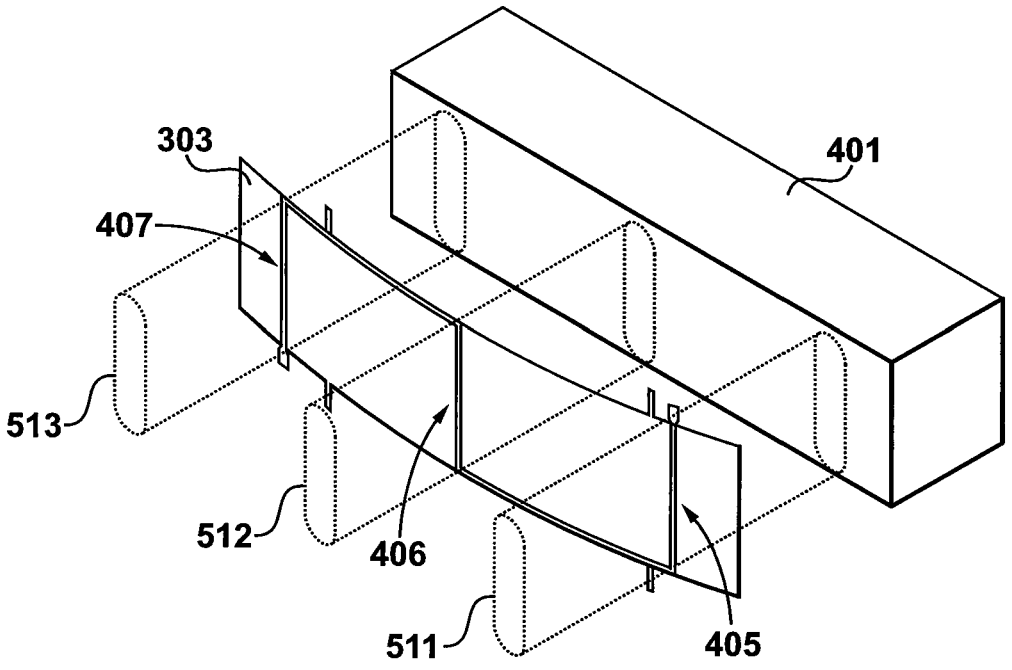

FIGS. 8A and 8B illustrate diaphragm 303 in greater detail.

Diaphragm 303 is shown face-on in FIG. 8A, and includes conductive element 402 disposed on this first face. Conductive element 402 includes a first terminal 801 and a second terminal 802 to allow electrical connections to be made.

In this embodiment, diaphragm 303 is a flexible printed circuit board, with the conductive element 402 having been printed on to it, possibly using PTF (polymer thick film) fabrication techniques or similar. Alternatively, diaphragm 303 could comprise a membrane sheet such as PET (polyethylene terephthalate), with conductive element 402 being, say, a copper or silver foil that is glued on to the diaphragm membrane.

Consider a scenario in which a battery is connected between first terminal 801 and second terminal 802 with current flowing from the first to the second terminal. Current will flow in the direction of arrow 805 in first portion 405 of the conductive element, in the direction of arrow 806 (the opposite direction to arrow 805) in second portion 406 of the conductive element, and in the direction of arrow 807 (the same direction as arrow 805) in third portion 407 of the conductive element.

Considering this scenario further, should the polarity of the battery be reversed, such that current would flow from second terminal 802 to first terminal 801, then the respective directions of current flow in the first, second and third portions of conductive element 402 will be reversed.

As shown in the Figure, the conductive element in the present embodiment forms a substantially square-cornered S-shape so as to achieve this flow of current. Alternative configurations may be provided—for example, three individual conductive elements could be used, with appropriate electrical connections being made such that current runs in parallel, but still maintaining the direction of current flow through the first, second and third portions of conductive element 402 described above.

FIG. 8B is an isometric view of diaphragm 303 mounted in a rest position in front of magnet system 401. As described previously with reference to FIGS. 5A and 5B, three loci of magnetic field (511, 512 and 513) are defined as regions of field in which the field vectors (501, 502 and 503) respectively have particular directions.

It will be seen from FIG. 8B that three portions of the conductive element 402 respectively coincide with the three loci of the magnetic field of magnet system—i.e. first portion 405 is embraced by first locus 511, second portion 406 is embraced by second locus 512, and third portion 407 is embraced by third locus 513. Thus, current carried through first portion 405 and third portion 407, and thus flowing through first locus 511 and third locus 513, flows in the opposite direction to current carried through second portion 406 and thus flowing through second locus 512.

As can be seen in the Figure, in this specific embodiment, the rest position of diaphragm 303 has a slightly curved or arcuate profile in a direction away from the magnet system. Encouraging this rest position may be achieved in practice by suitable shaping to the enclosure, the baffle and the deformable surround used to support the diaphragm in the loudspeaker. The advantages associated with this rest position are expanded upon with reference to FIGS. 9A through 10B.

FIGS. 9A & 9B

Figure 9A:
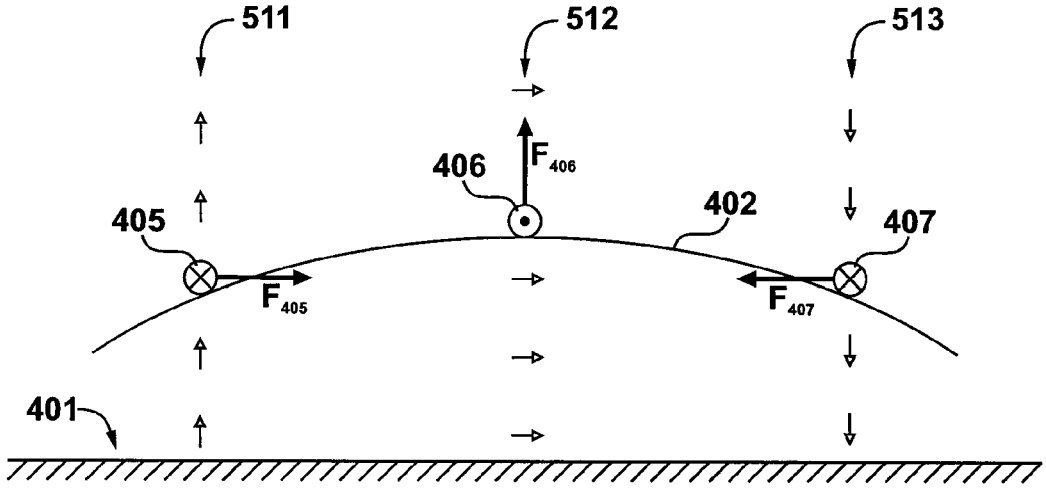
FIGS. 9A, 9B, 10A and 10B show the principle of operation of the loudspeaker.
Figure 9B:
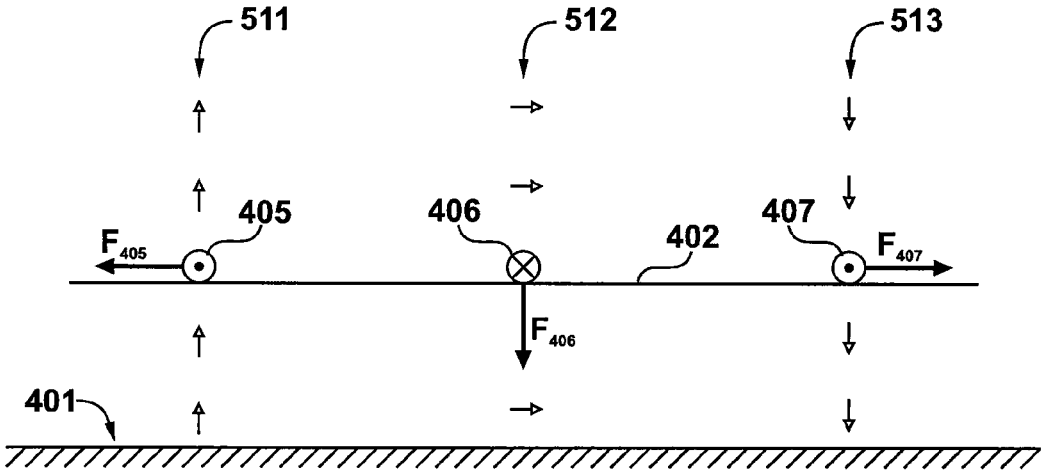

FIGS. 9A and 9B are top-down views of the magnet system and the diaphragm, and show the effect on diaphragm 303 of passing an electrical current through the conductive element 402.

As described previously with reference to FIG. 8B, the three portions 405, 406 and 407 of conductive element 402 coincide with the three loci 511, 512 and 513 of the magnetic field of magnet system 401. By combining the Lorentz force law with the definition of electrical current, it may be shown that the force F exerted upon a straight, stationary wire is:

$$F = I\mathbf{l} \times B \qquad \text{(Equation 1)}$$

where I is the conventional current, l is a vector whose magnitude is the length of wire, and whose direction is along the wire, and B is the magnetic field.

Thus, as shown in FIG. 9A, compression of air in front of diaphragm 303 is achieved by passing a current of one polarity through conductive element 402, i.e. from first terminal 801 to second terminal 802. The direction of current flow is illustrated using the standard notation of vectors going into and out of a plane. Thus, with respect to the plane of the Figure, current is flowing downwards through first portion 405 and third portion 407, whilst it is flowing upwards through second portion 406.

The result of current flowing in this manner through the three portions of conductive element 402, each being embraced by a respective locus of the magnetic field of magnet system 401, is that Lorentz forces are exerted upon the conductive element. Thus, first portion 405 of the conductive element experiences a Lorentz force $F_{405}$, second portion 406 of the conductive element experiences a Lorentz force $F_{406}$, and third portion 407 of the conductive element experiences a Lorentz force $F_{407}$. By inspection of Equation 1 and its inclusion of the vector cross product, it will be understood that the direction of forces $F_{405}$ and $F_{407}$ is towards one another and parallel to magnet system 401, such that first portion 405 and third portion 407 of the conductive element 402 are pulled toward one another, whilst the direction of force $F_{406}$ is normal to and away from magnet system 401. This results in conductive element 402, and therefore diaphragm 303, deforming towards a more arcuate condition with current flowing from first terminal 801 to second terminal 802.

Referring now to FIG. 9B, rarefaction of air in front of diaphragm 303 is achieved by reversing the polarity of the current flow, i.e. current flowing from second terminal 902 to first terminal 901. As shown in the Figure, current is flowing upwards through first portion 405 and third portion 407, whilst it is flowing downwards through second portion 406. Thus, with current flow operating in this condition, reversal of the direction of the Lorentz forces occurs: forces $F_{405}$ and $F_{407}$ can now be seen to be directed away from one another and parallel to magnet system 401, such that first portion 405 and third portion 407 of the conductive element are pushed away from one another, whilst the direction of force $F_{406}$ is normal to and towards magnet system 401.

Considering the application of an audio signal having positive and negative half cycles to conductive element 402, and given appropriate electrical connections from a source, it can be seen that diaphragm 303 will deform from its rest position to a generally arcuate condition during negative half cycles, as illustrated in FIG. 9A, whilst during positive half cycles, it will deform to a generally planar condition as illustrated in FIG. 9B. This is achieved by it having the rest position described previously with reference to FIG. 8B.

The advantage of the diaphragm vibrating between an arcuate condition and a planar condition as illustrated in FIGS. 9A and 9B is that a wide dispersion angle of sound is achieved, thereby improving the sound field generated. In addition, magnets are only required on one side of the diaphragm, which is not the case with planar magnetic designs.

FIGS. 10A & 10B

Figure 10A:
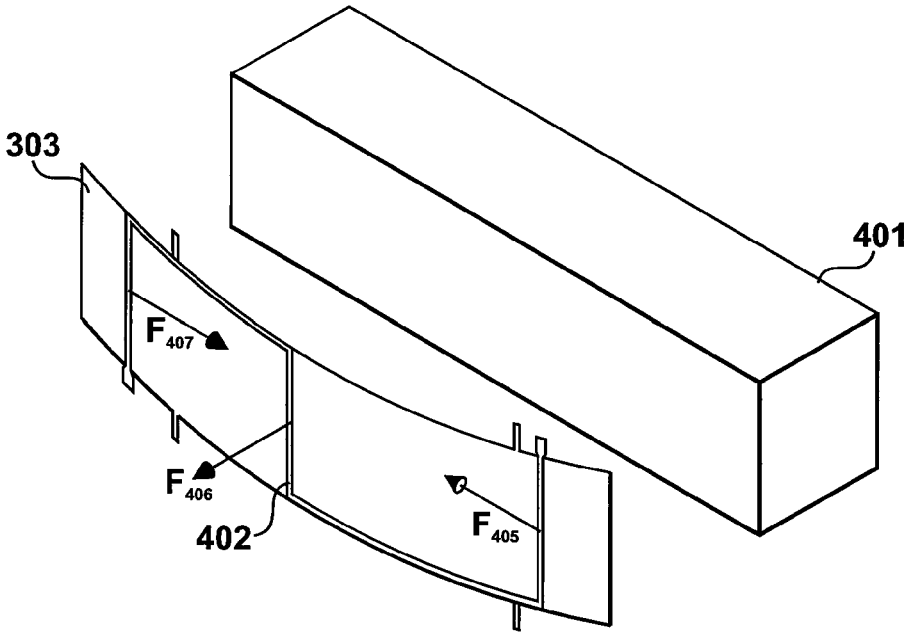
Figure 10B:
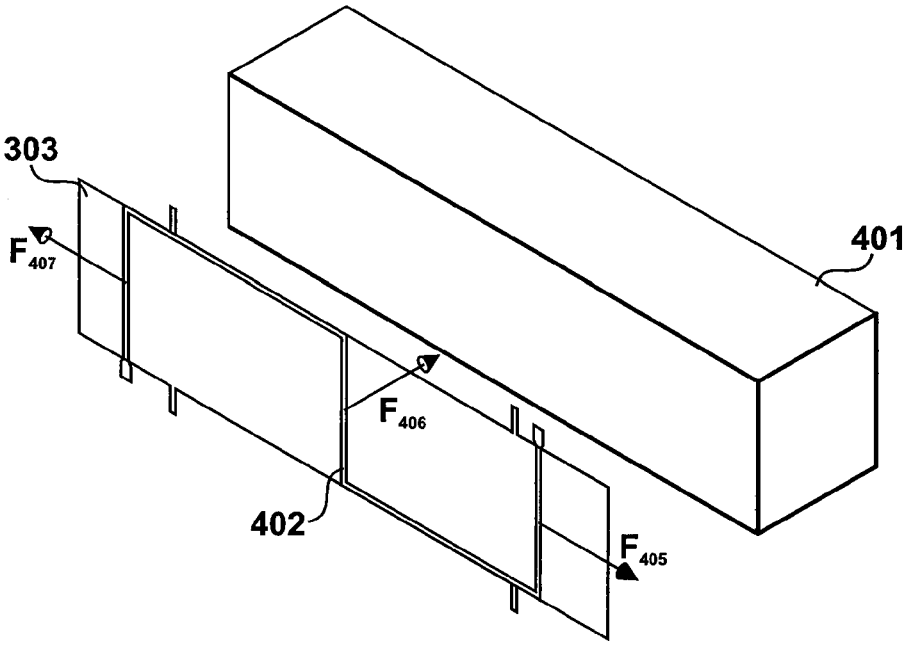

An isometric view of diaphragm 303 and magnet system 401 is shown in FIGS. 10A and 10B, showing the deforming of diaphragm 303 due to Lorentz forces $F_{405}$, $F_{406}$ and $F_{407}$ acting upon conductive element 402, as described previously with reference to FIGS. 9A and 9B respectively.

FIG. 11

In an alternative embodiment of the present invention, the conductive element is extended to the other side of the diaphragm. Thus, a diaphragm 1101 suitable for use in place of diaphragm 303, is shown in FIGS. 11A and 11B including an extended conductive element 1102.

Figure 11A:
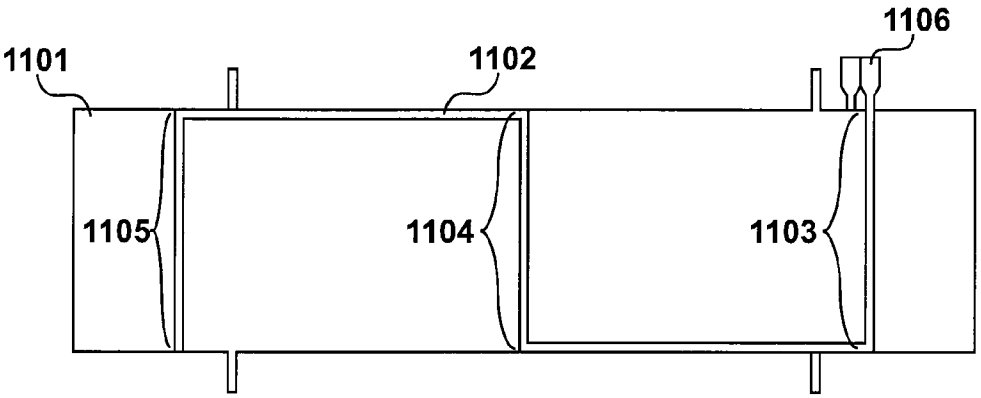
FIGS. 11A and 11B show an second embodiment of a diaphragm for use in the loudspeaker, having an extended conductive element.

FIG. 11A shows the configuration of conductive element 1102 on a first face of diaphragm 1101.

On this face, conductive element 1102 has a substantially similar configuration to conductive element 402, in that it features three portions (a first portion 1103, a second portion 1104 and a third portion 1105) which, when diaphragm 1101 is embraced by the magnetic field of magnet system 401 will coincide with first locus 511, second locus 512, and third locus 513 respectively. On this face, conductive element 1101 includes a first terminal 1106 to facilitate electrical connection.

Figure 11B:
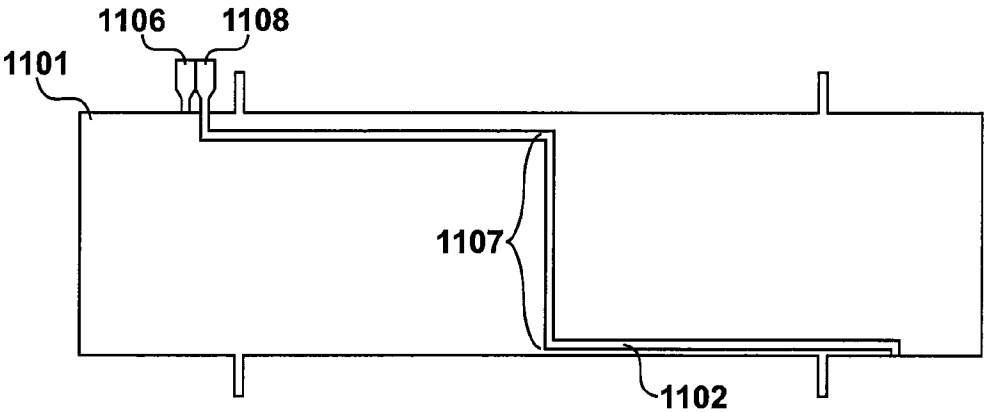

Additionally, conductive element 1102 extends onto the second face of diaphragm 1101, as shown in FIG. 11B. The extension of conductive element 1101 is achieved in practice by either folding the conductive material over onto either side of the diaphragm before being bonded thereto, or using a crossover connection. On this face of diaphragm 1101, conductive element 1102 forms a square-cornered Z-shape, and therefore forms an additional, fourth portion 1107 of conductive element. Fourth portion 1107 will, along with second portion 1104, coincide with second locus 512 of the magnetic field. This has the effect of doubling the amount of current flowing through second locus 512 at any one time as current will flow in the same direction through both second portion 1104 and fourth portion 1107. This results in a doubling in the Lorentz force (compare with force $F_{406}$ of FIGS. 9A and 9B) exerted upon conductive element 1102 at that location. Additionally, on this face, conductive element 1201 includes a second terminal 1108, again to facilitate electrical connection.

In a similar way to conductive element 402, conductive element 1102 is printed onto diaphragm 1101. It may alternatively be attached using an adhesive for example.

FIG. 12

Figure 12:
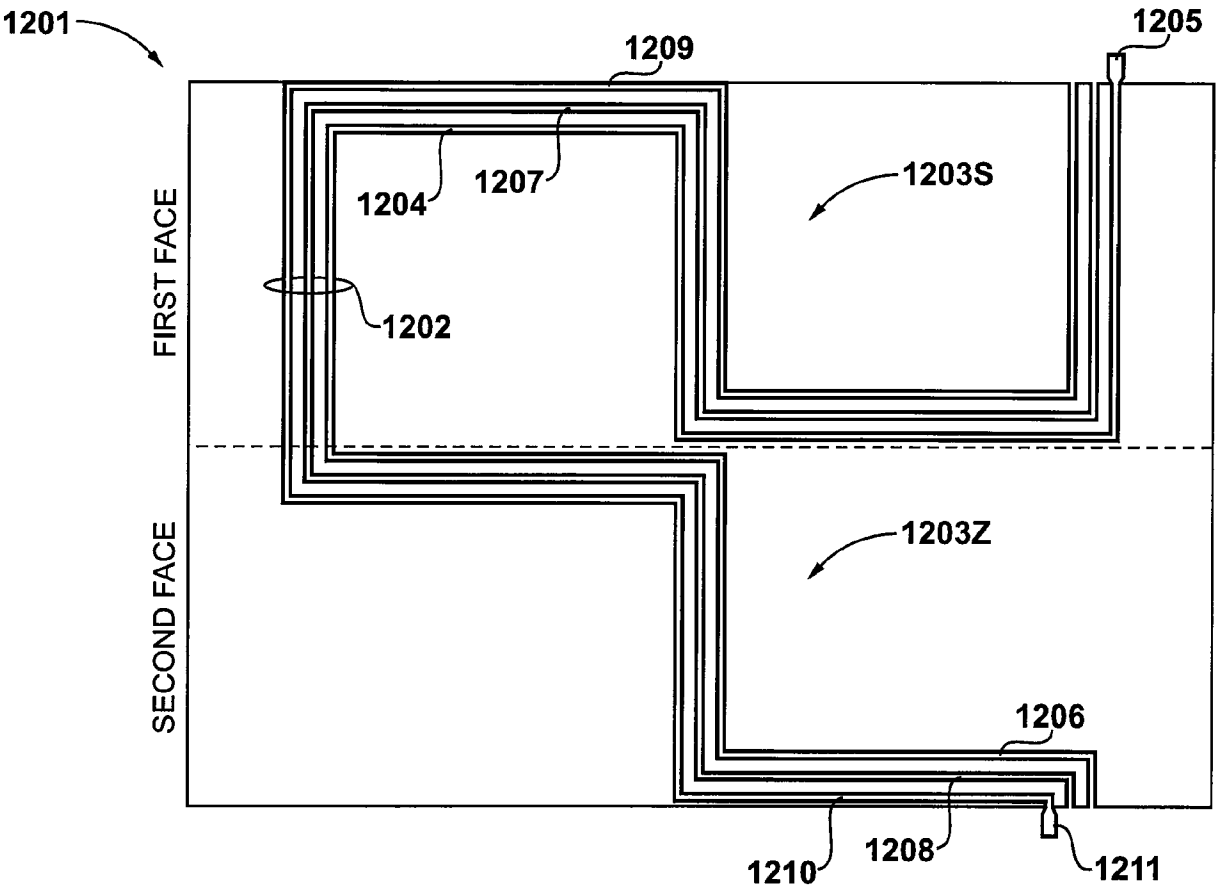
FIG. 12 shows a third embodiment of a diaphragm, having a further extended conductive element.
Figure 13:
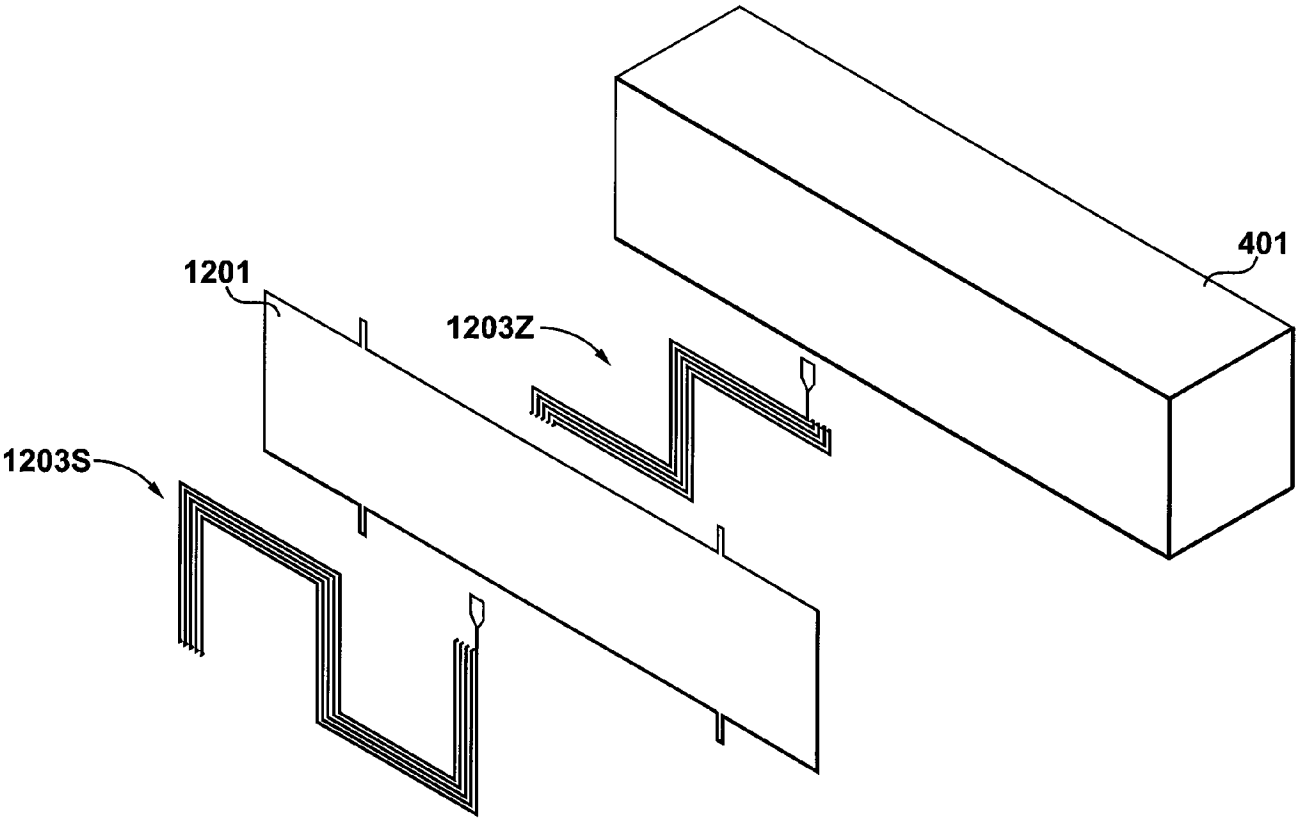
FIG. 13 is an isometric view of the third diaphragm embodiment illustrated in FIG. 12.

A second alternative diaphragm 1201 is shown in FIG. 12, in which extension of the conductive element, in the manner described with reference to FIG. 11, has been repeated a number of times. Diaphragm 1201 therefore has disposed upon it a conductor 1202, and is suitable for use in place of diaphragm 303.

The scenario shown in FIG. 12 is purely exemplary to aid understanding, and would be the view if the diaphragm had been cut in half and laid flat.

Conductive element 1202 includes an S-shape part 1203S which, in practice, is located on a first face of diaphragm 1201. S-shape part 1203S is made up of a set of S-shaped portions of conductive element 1202. Additionally, a Z-shape part 1203Z, made up of a set of Z-shaped portions of conductive element 1202, is joined to S-shape part 1203S. In practice it is located on a second face of diaphragm 1201.

The conductive element 1202 is made up of first square-cornered S-shaped portion 1204, similar to that shown in FIG. 11A, and which includes a first terminal 1205. First square-cornered S-shaped portion 1204 is joined to a first square-cornered Z-shaped portion 1206, similar to that shown in FIG. 11B.

However, instead of first Z-shaped portion 1206 being terminated at this point, its end is positioned so as to allow electrical connection to a second S-shaped portion 1207. Joined to second S-shaped portion 1207 is a second square-cornered Z-shaped portion 1208, again whose end is positioned so as to allow electrical connection to a third S-shaped portion 1209. Finally, third square-cornered S-shaped portion 1209 is joined to a third square-cornered Z-shaped portion 1210, which is terminated by a second terminal 1211.

Thus, a tripling in the amount of current-carrying material which will be located within each of the three loci of the magnetic field of magnet system 401 over that available with conductive element 1102 is achieved. This results in three times the strength of Lorentz force being exerted upon the conductive element 1202. Of course, the number of repetitions of the square-cornered S-shape and Z-shape parts of the conductive element need not be three—any number may be used depending upon the design requirements and the application.

FIG. 13

Figure 14:
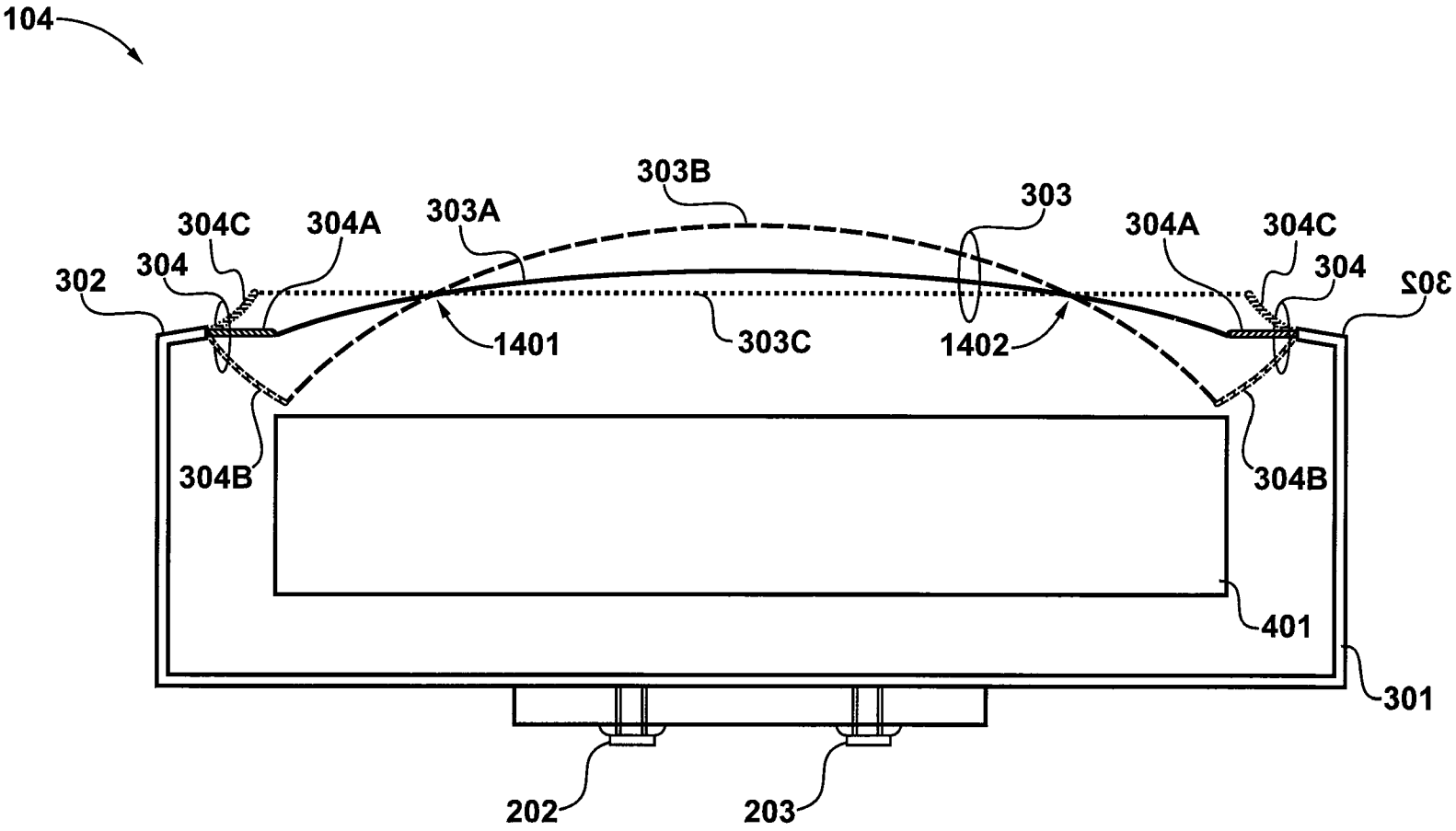
FIG. 14 shows an embodiment of the present invention in which the volume inside the loudspeaker does not change during operation.

An exploded isometric view of diaphragm 1201 and conductive element 1202—comprising S-shaped part 1203S and Z-shaped part 1203Z—in the vicinity of magnet system 401 is shown in FIG. 14. In practice, conductive element 1202 would of course be bonded to diaphragm 1201.

It is important to note that whilst the embodiments of the present invention described herein make reference to, for instance, magnet system 401 being a Halbach array, and conductive element 402 being a square-cornered S-shape, other configurations could of course be used. The present invention extends to any configuration of magnet system, diaphragm and associated conductive element which result in forces being generated parallel to the magnet system occurring on outer portions of the diaphragm, and force being generated normal to the magnet system occurring on a central portion of the diaphragm, so as to cause oscillation of the diaphragm in response to the application of an audio frequency signal to the conductive element.

FIG. 14

As described previously with reference to FIG. 4, in the present embodiment, enclosure 301 in which diaphragm 303 (or alternatively diaphragms 1101 or 1201) and the magnet system are mounted may be sealed. FIG. 14 illustrates this configuration and the advantages it confers.

Loudspeaker 303 is shown in cross section in the Figure. For the purposes of simplicity of presentation, positive cable 403 and negative cable 404 are omitted from the drawing but would of course be present in practice and connected between terminals 202 and 801, and terminals 203 and 802. In operation, diaphragm 303 will deform in the manner previously described with reference to FIGS. 9A through 10B. This will in turn cause deformation of deformable surround 304, in that it will move and stretch.

Example excursions of diaphragm 303 and deformable surround 304 from their conditions at rest 303A and 304A respectively are shown in FIG. 14 with dashed lines. These excursions are respectively reached during positive and negative half cycles of an applied audio signal. Thus, the conditions of the diaphragm and the deformable surround during a negative half cycle, causing compression of air, are shown at 303B and 304B respectively. The conditions of the diaphragm and the deformable surround during a positive half cycle, causing rarefaction of air, are shown at 303C and 304C respectively.

As described previously with reference to FIG. 4, diaphragm 303 includes a quartet of locating tabs. These provide a pivot point around which the diaphragm may deform. These pivot points are shown in FIGS. 14 at 1401 and 1402. Appropriate selection of these pivot points result in the total volume inside the enclosure remaining constant when the diaphragm is energised by passing an audio signal through the conductive element, enabling enclosure 301 to be sealed and thereby creating an isochoric (constant volume) process which reduces the tendency of air moving in and out of an enclosure to cause distortion.

It will be appreciated by those skilled in the art that, whilst the embodiments of the present invention described herein have referred mainly to application as a loudspeaker, the principles may also be applied to microphone design.

What we claim is:

1. An acoustic transducer comprising a magnet system and a diaphragm having a conductive element disposed thereon which is embraced by the magnetic field of the magnet system, wherein the magnetic field has a first locus with field vectors normal to and directed away from the magnet system, a second locus with field vectors directed parallel to the magnet system, and a third locus with field vectors normal to and directed toward to the magnet system, and wherein the conductive element comprises a first outer conductive portion arranged to coincide with said first locus and a second outer conductive portion arranged to coincide with said third locus for generating force parallel to the magnet system, and a central conductive portion arranged to coincide with said second locus for generating force normal to the magnet system;

and wherein application of an audio frequency signal to the conductive element causes current to be carried by the conductive element in one direction through the first and third loci of the magnetic field, and in the opposite direction through the second locus of the magnetic field, thereby causing oscillation of the diaphragm.

2. The acoustic transducer of claim 1, in which the magnet system has a spatially rotating pattern of magnetisation.

3. The acoustic transducer of claim 2, in which the magnet system is a Halbach array.

4. The acoustic transducer of claim 1, in which a current carried through the conductive element results in Lorentz forces being exerted on the conductive element, in a direction parallel to the magnet system at the first and second outer conductive portions, and in a direction normal to the magnet system at the central conductive portion.

5. The acoustic transducer of claim 4, wherein the Lorentz forces cause the diaphragm to oscillate between a generally arcuate condition during a negative half cycle of an audio frequency signal, and towards a generally planar condition during a positive half cycle of an audio frequency signal.

6. The acoustic transducer of claim 5, in which the diaphragm, at rest, has a generally arcuate profile in one direction.

7. The acoustic transducer of claim 1, in which the conductive element is disposed only a first face of the diaphragm.

8. The acoustic transducer of claim 7, in which the conductive element has a substantially square-cornered S-shape forming the first and second outer conductive portions and the central conductive portions.

9. The acoustic transducer of claim 1, in which the conductive element is disposed on both a first face and a second face of the diaphragm, where the first face is on an opposite side of the diaphragm to the second face.

10. The acoustic transducer of claim 7, wherein:

on the first face of the diaphragm, the conductive element has a substantially square-cornered S-shape, forming the first and second outer conductive portions and the central conductive portion; and on the second face of the diaphragm, the conductive element has a substantially square-cornered Z-shape, thereby forming a second central conductive portion that coincides with the second locus of the magnetic field.

11. The acoustic transducer of claim 10, in which the conductive element forms at least one additional substantially square-cornered S-shape on the first face of the diaphragm, and at least one additional substantially square-cornered Z-shape of the second shape of the diaphragm.

12. The acoustic transducer of claim 1, in which the diaphragm is a flexible printed circuit board.

13. The acoustic transducer of claim 1, configured to operate as a loudspeaker.

14. The acoustic transducer of claim 13, further comprising an enclosure having a front baffle into which the periphery of the diaphragm is mounted using a deformable surround.

15. The acoustic transducer of claim 14, in which the enclosure is sealed, and wherein the volume of air within the enclosure does not change when the diaphragm oscillates, so as to form an isochoric process.

16. The acoustic transducer of claim 13, forming part of one of:

a pair of headphones;

a sound bar;

a television;

a portable computer.

17. The acoustic transducer of claim 1, configured to operate as a microphone.

18. A method of generating sound in which a diaphragm is excited so as to cause compression and rarefaction of air, the method comprising:

generating, with a magnet system, a magnetic field that embraces the diaphragm, wherein the magnetic field has a first locus with field vectors normal to and directed away from the magnet system, a second locus with field vectors directed parallel to the magnet system, and a third locus with field vectors normal to and directed toward to the magnet system; and applying an audio signal through a conductive element disposed on the diaphragm, the conductive element comprising a first outer conductive portion arranged to coincide with said first locus and a second outer conductive portion arranged to coincide with said third locus for generating force parallel to the magnet system, and a central conductive portion arranged to coincide with said second locus for generating force normal to the magnet system, so that current is carried by the conductive element in one direction through the first and third loci of the magnetic field, and in the opposite direction through the second locus of the magnetic field, thereby creating Lorentz forces that act upon the conductive element, which:

cause the diaphragm to deform towards a generally arcuate condition during half-cycles of the audio signal having a first polarity, and cause the diaphragm to deform towards a generally planar condition during half-cycles of the audio signal having a second polarity.

19. The method of claim 18, in which the magnetic field is generated by a magnet system with a spatially rotating pattern of magnetisation.

* * * * *